US006443138B1

(12) United States Patent
Franks et al.

(10) Patent No.: US 6,443,138 B1
(45) Date of Patent: Sep. 3, 2002

(54) FULL RANGE FUEL SHIFT DETERMINATION

(75) Inventors: Kerry D Franks, Chelsea; Paul R Arlauskas, Walled Lake; Jeremy M Smith, Farmington; Iqbal A Chowdhury, Madison Heights, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/629,487

(22) Filed: Jul. 31, 2000

(51) Int. Cl.[7] ..... F02M 33/02
(52) U.S. Cl. ..... 123/698; 123/520
(58) Field of Search ..... 123/520, 518, 123/519, 698

(56) References Cited

U.S. PATENT DOCUMENTS

| | | | | | |
|---|---|---|---|---|---|
| 4,703,736 | A | | 11/1987 | Atkins, Sr. | 123/519 |
| 4,821,701 | A | * | 4/1989 | Nankee et al. | 123/520 |
| 5,005,550 | A | | 4/1991 | Bugin, Jr. et al. | 123/520 |
| 5,024,687 | A | | 6/1991 | Waller | 55/316 |
| 5,255,661 | A | * | 10/1993 | Nankee et al. | 123/672 |
| 5,469,832 | A | * | 11/1995 | Nemoto | 123/518 |
| 5,495,749 | A | | 3/1996 | Dawson et al. | 73/49.7 |
| 5,497,757 | A | * | 3/1996 | Osanai | 123/674 |
| 5,623,914 | A | * | 4/1997 | Kawamoto et al. | 123/689 |
| 5,651,349 | A | * | 7/1997 | Dykstra et al. | 123/198 D |
| 5,682,869 | A | | 11/1997 | Nankee, II et al. | 123/698 |
| 5,785,033 | A | * | 7/1998 | Kawamoto et al. | 123/198 D |
| 5,909,727 | A | * | 6/1999 | Nakagawa | 123/520 |
| 5,988,150 | A | * | 11/1999 | Osanai | 123/698 |
| 6,047,688 | A | | 4/2000 | Duty et al. | 123/520 |
| 6,085,731 | A | | 7/2000 | Duty | 123/520 |
| 6,095,121 | A | * | 8/2000 | Osanai | 123/520 |

FOREIGN PATENT DOCUMENTS

| | | | | |
|---|---|---|---|---|
| EP | 0675278 | * | 10/1998 | F02M/25/08 |
| JP | 14062 | * | 1/1997 | F02M/25/08 |

* cited by examiner

*Primary Examiner*—Tony M. Argenbright
*Assistant Examiner*—Hai H. Huynh
(74) *Attorney, Agent, or Firm*—Ralph E. Smith

(57) ABSTRACT

A control system for controlling the fueling of an engine assembly. The engine assembly includes an internal combustion engine, a fuel control system, a fuel vapor storage canister and a purge control system for purging the fuel vapor storage canister. The control system includes a purge fuel vapor measuring device for measuring an amount of purge fuel vapor flowing from the vapor storage canister to the internal combustion engine, a fuel corruption estimating device for estimating an amount of fuel corruption as a function of the amount of purge fuel vapor flowing from the vapor storage canister to the internal combustion engine and a controller for adapting the control of the internal combustion to the estimate of the amount of fuel corruption. A method for fueling an engine assembly having an internal combustion engine is also provided.

18 Claims, 2 Drawing Sheets

FULL RANGE FUEL SHIFT DETERMINATION

BACKGROUND OF THE INVENTION

1. Technical Field

The present invention relates generally to purge control systems for internal combustion engines and more particularly to a method for controlling a vapor storage canister for a purge control system of an internal combustion engine.

2. Discussion

Stricter Federal and California evaporative emission standards for automotive vehicles require that Federal Test Procedure (FTP) emission levels be measured with a loaded vapor canister. The standards require that the automotive vehicle undergo an FTP emission cycle, after which the vehicle is placed in a variable temperature shed and resting loss emissions re measured over a predetermined time period.

Under normal automotive vehicle operating conditions, fuel vapors present within the vehicle's fuel tank are temporarily stored inside a vapor storage canister. These devices are known in the art as purge canisters or vapor storage canisters. A typical vapor storage canister contains a quantity of activated charcoal as the preferred medium for storing the fuel vapors. The storage capacity of the vapor storage canister is limited by the mass and volume of charcoal after becoming saturated with absorbed fuel vapor. Therefore, it is necessary to periodically purge the vapor storage canister with fresh air to remove the fuel vapor and restore the storage potential of the canister.

Typically, a purge control system is used to purge the vapor storage canister. The purge control system includes a purge solenoid which is turned ON and OFF to control fuel vapor purged from the vapor storage canister. An example of such a purge control system is disclosed in U.S. Pat. No. 4,821,701 to Nankee II et al. Another example of a purge control system for controlling and varying the amount of purge flow from the vapor storage canister to the internal combustion engine is disclosed in U.S. Pat. No. 5,263,460 to Baxter et al.

One problem associated with the use of such purge control systems is that the amount of fuel which they deliver to the internal combustion engine during a purge cycle is not quantified. Accordingly, in situations where a substantial amount of fuel vapor is being generated (e.g., where the vehicle is operating in a relatively hot environment or where the vehicle is fueled with an oxygenated fuel), operation of the purge control system in an ON condition is likely to be frequent and provide the internal combustion engine with a relatively large supply of fuel. The delivery of fuel to the internal combustion engine via the purge control system is likely to cause erratic engine operation, particularly when the vehicle is idling and a heavy load is applied to the engine, as when actuating an air conditioning compressor.

When the engine is idling and the purge control system is turned ON, for example, the additional fuel being delivered to the internal combustion engine causes a rich burn situation wherein the ratio of fuel to air is higher than a desired stoichiometric ratio. This situation is typically detected via an oxygen sensor. In response to the detection of a rich burn situation, the engine controller typically reduces the amount of fuel that is being delivered to the internal combustion through the primary fueling means (e.g., injectors) to return the fuel-to-air ratio to the desired stoichiometric ratio. In response to the application of a heavy load to the engine, the idle speed motor opens the throttle, causing the engine to ingest relatively more air and altering the fuel-to-air ratio to create a lean bun situation and reducing the available engine torque. The lean burn situation is the result of the failure to estimate or predict the quantity of fuel that is being delivered to the engine for combustion from the purge canister and the corresponding need to retard the rate with which the injectors are permitted to change the amount of fuel that is delivered to the engine so as to avoid over reacting to variances in the amount of fuel that is being delivered from the purge canister. The speed of the engine will vary widely until a sufficient amount of time has elapsed to permit the fuel-to-air ratio to return to the desired stoichiometric ratio.

Accordingly, there remains a need in the art for a device for controlling the fueling of an engine assembly which estimates the amount of fuel that is being delivered to the engine for combustion from a purge canister. There also remains a need in the art for a method of fueling an engine that more accurately accounts for the amount of fuel that is being delivered to the engine for combustion from a purge canister.

SUMMARY OF THE INVENTION

In one preferred form, the present invention provides a control system for controlling the fueling of an engine assembly. The engine assembly includes an internal combustion engine, a fuel control system, a fuel vapor storage canister and a purge control system for purging the fuel vapor storage canister. The control system includes a purge fuel vapor measuring device for measuring an amount of purge fuel vapor flowing from the vapor storage canister to the internal combustion engine, a fuel corruption estimating device for estimating an amount of fuel corruption as a function of the amount of purge fuel vapor flowing from the vapor storage canister to the internal combustion engine and a controller for adapting the control of the internal combustion to the estimate of the amount of fuel corruption. A method for fueling an engine assembly having an internal combustion engine is also provided.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENT

Figure 1:
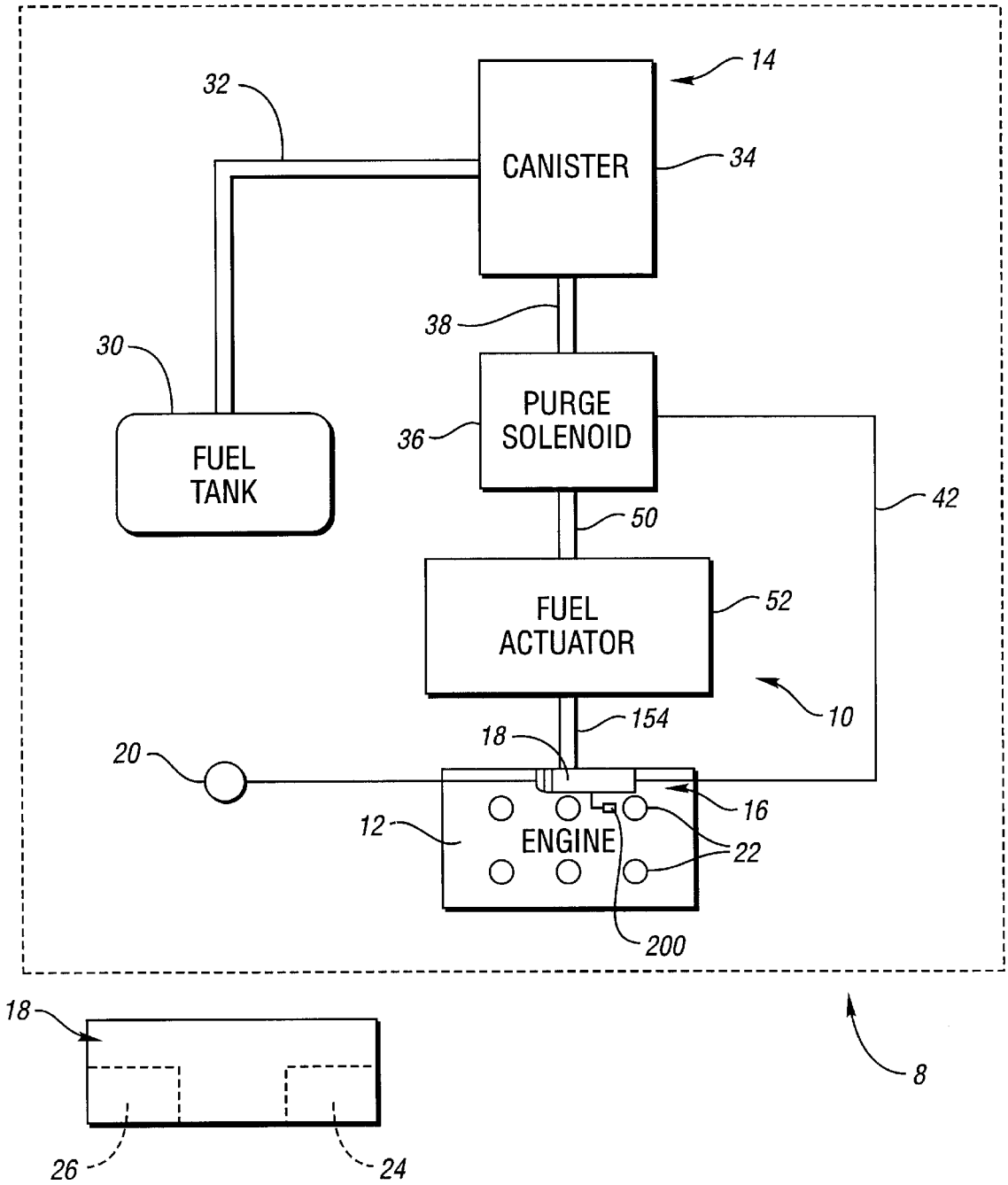
FIG. 1 is a schematic diagram of a vehicle constructed in accordance with the teachings of the present invention.

With reference to FIG. 1 of the drawings, a vehicle constructed in accordance with the teachings of a preferred embodiment of the present invention is generally indicated by reference numeral 8. Vehicle 8 is shown to include an engine assembly 10 having an internal combustion engine 12 and a purge control system 14. Internal combustion engine 12 includes a fuel control system 16 for delivering a primary charge of fuel to internal combustion engine 12 for combustion. In the particular embodiment illustrated, fuel control system 16 includes a controller 18, an oxygen sensor 20 and a plurality of fuel injectors 22. Controller 18 includes an adaptive memory 24 and a timer 26. Fuel injectors 22 are operable for injecting fuel into internal combustion engine 12 for subsequent combustion. Fuel injectors 22 are electronically actuated to dispense fuel into internal combustion engine, with the amount of fuel that is dispensed being proportional to the bandwidth of an electronic pulse that is operable for actuating each of the fuel injectors 22. Oxygen sensor 20 is positioned to monitor the exhaust of internal combustion engine 12 and responsively generate an oxygen sensor signal which is employed by fuel control system 16 to determine if internal combustion engine 12 is operating at a fuel-to-air ratio which is different than a predetermined stoch ratio.

Purge control system 14 includes a fuel tank 30 connected by a conduit 32 to a purge or vapor storage canister 34. Under normal operating conditions, fuel vapors form in fuel tank 30 and are directed through conduit 32 into vapor storage canister 34. Purge control system 14 also includes a purge solenoid 36 connected by a conduit 38 to vapor storage canister 34. Purge control system 14 is coupled to controller 18 which controls the flow (ON or OFF) of the purge solenoid 36. Controller 18 may conventionally include a microprocessing unit, an input/output module, communication lines, and other hardware and software necessary to control tasks of engine control such as fuel to air ratios, fuel spark timing, or exhaust gas recirculation. When controller 18 turns purge solenoid ON, fuel vapor is purged from vapor storage canister 34 and through a conduit 50 and into a fuel actuator 52. Fuel actuator 52 delivers a mixture of fuel and vapors through a conduit 54 to internal combustion engine 12. It should be appreciated that purge control system 14 may include other sensors, transducers or the like in communication with controller 18 to carry out the method to be described. It should also be appreciated that unless otherwise detailed herein, purge control system 14 may be similar to that disclosed in U.S. Pat. Nos. 4,821,701 to Nankee II et al. and U.S. Pat. No. 5,263,460 to Baxter et al.

Figure 2:
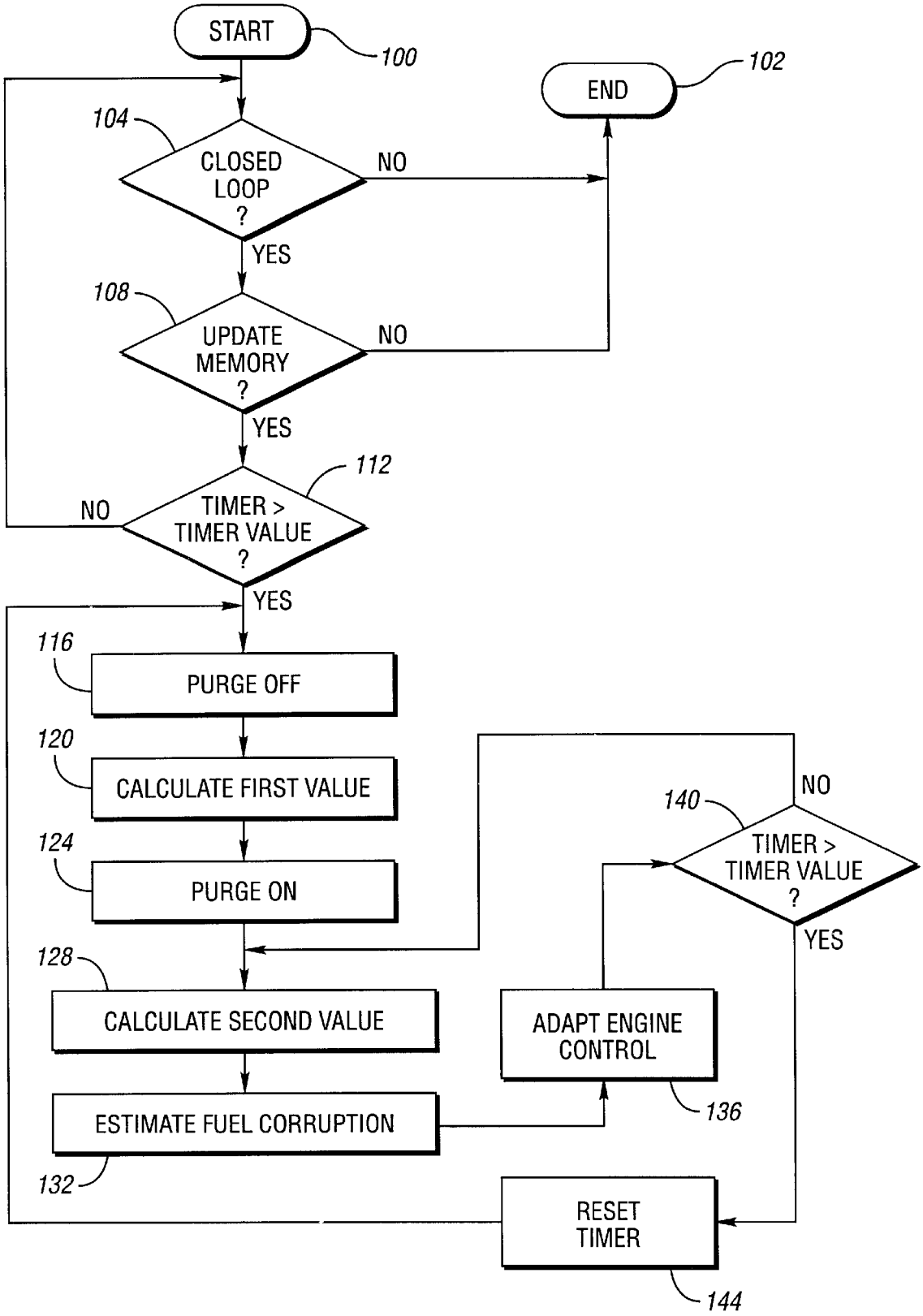
FIG. 2 is a schematic illustration in flowchart form of the method of the present invention.

Referring to FIG. 2, the method of the present invention is schematically illustrated in flowchart form. The method begins at bubble 100 and proceeds to decision block 104 where the methodology determines if fuel control system 16 is operating in a closed loop manner. In the particular embodiment disclosed, fuel control system 16 is operating in a closed loop manner when data from oxygen sensor is employed to tailor the amount of fuel that injectors 22 dispense to maintain the fuel-to-air ratio at the predetermined stoichiometric ratio. If fuel control system 16 is not operating in a closed loop manner (e.g., during engine start-up), the methodology proceeds to bubble 102 where the methodology terminates. If the fuel control system 16 is operating in a closed loop manner in decision block 104, the methodology proceeds to decision block 108.

In decision block 108, the methodology determines if adaptive memory 24 is permitted to update. If adaptive memory is not permitted to update, as when adaptive memory 24 is running a diagnostic program or is damaged, the methodology proceeds to bubble 102 where the methodology terminates. If adaptive memory 24 is permitted to update in decision block 108, the methodology proceeds to decision block 112.

In decision block 112 the methodology determines if the value in timer 26 exceeds a predetermined timer value. Timer 26 is employed to limit the frequency with which the methodology of the present invention is performed so as to avoid adversely affecting the operation of internal combustion engine 12. If the value in timer 26 does not exceed the predetermined timer value, the methodology loops back to decision block 104. If the value in timer 26 exceeds the predetermined timer value in decision block 112, the methodology proceeds to block 116.

In block 116, the methodology causes controller 18 to control purge solenoid 36 such that the flow of purge vapor from the vapor canister 34 is OFF (i.e., fuel is not being supplied to internal combustion engine 12 from vapor canister 34 for combustion).

The methodology then proceeds to block 120 where a first value which is indicative of the operation of the internal combustion engine 12 when internal combustion engine 12 is not combusting fuel from the fuel vapor storage canister 34. In calculating the first value, controller 18 monitors the oxygen sensor signal from oxygen sensor 20 and calculates a first median oxygen filter value. Controller 18 also determines a first median fuel correction value which is equal to the median fuel correction value during the times when internal combustion engine 12 is not combusting fuel from the fuel vapor storage canister 34. In the particular example provided, the first value is equal to the product of the first median oxygen filter value and the first median fuel correction value. Those skilled in the art will understand that the first median fuel correction value tends to vary over a period of time, taking into account various factors including engine wear and the degree to which injectors 22 are plugged. Once the first median oxygen filter and the first median fuel correction values have been determined by controller 18, the first value is then calculated by multiplying the first median oxygen filter value by the first median fuel correction value.

The methodology next proceeds to block 124 where controller 18 is actuated to control purge solenoid 36 such that the flow of purge vapor from the vapor canister 34 is ON (i.e., fuel is being supplied to internal combustion engine 12 from vapor canister 34 for combustion). The method then proceeds to block 128.

In block 128, the methodology calculates a second value indicative of the operation of internal combustion engine 12 when internal combustion engine 12 is combusting fuel from the vapor storage canister 34. In calculating the second value, controller 18 monitors the oxygen sensor signal from oxygen sensor 20 and calculates a second median oxygen filter value. Controller 18 also determines a second median fuel correction value which is equal to the median fuel correction value during the times when internal combustion engine 12 is combusting fuel from the fuel vapor storage canister 34. Those skilled in the art will understand that like the first median fuel correction value, the second median fuel correction value tends to vary over a period of time, taking into account various factors including engine wear and the degree to which injectors 22 are plugged. Once the second median oxygen filter and the second median fuel correction values have been determined by controller 18, the second value is then calculated by multiplying the second median oxygen filter value by the second median fuel correction value. Those skilled in the art will understand that as the amount of fuel being delivered to internal combustion engine 12 via the fuel injectors 22 is known, the step of calculating the second value is analogous to measuring an amount of purge fuel vapor flow from the fuel tank to the engine and responsively producing a purge fuel vapor flow signal (i.e., the second value).

The methodology next proceeds to block 132 where the first and second values are employed to calculate a correction term or corruption signal that estimates the magnitude of fuel corruption. In the particular example provided, the correction term is equal to the difference between the first value and the second value and provides a number between zero (0) and one (1), with a value of zero (0) indicating no fuel corruption and a value of one (1) indicating the highest level of fuel corruption. The methodology proceeds to block 136 where timer 26 is reset and controller 18 adapts the control of the engine as a function of the correction term (corruption signal). The methodology then proceeds to decision block 140.

In decision block 140, the methodology determines if the value in timer 26 exceeds the predetermined timer value previously mentioned in decision block 112. If the value in timer 26 does not exceed the predetermined timer value, the methodology loops back to block 128 where the second value is recalculated based on updated or current values of the second median oxygen filter and the second median fuel correction values. If the value in timer 26 exceeds the predetermined timer value in decision block 140, the methodology proceeds to block 144 where the timer 26 is reset. Thereafter, the methodology loops back to block 116 to permit the first value to be recalculated. Those skilled in the art will understand that other predetermined conditions, such as a fuel temperature which exceeds a predetermined fuel temperature limit, may alternatively or additionally be employed to trigger the recalculation of the first value. As those skilled in the art will understand, a fuel temperature sensor 200 (FIG. 1) may be employed for monitoring the temperature of the fuel that is being delivered to engine 12 for combustion and generating a fuel temperature sensor signal in response thereto.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A method for fueling an engine assembly having an internal combustion engine, a fuel control system, a fuel vapor storage canister and a purge control system for purging the fuel vapor storage canister, the method comprising the steps of:

calculating a first value indicative of the operation of the internal combustion engine when the internal combustion engine is not combusting fuel from the fuel vapor storage canister;

calculating a second value indicative of the operation of the internal combustion engine when the internal combustion engine is combusting fuel from the vapor storage canister;

using the first and second values to calculate a correction term to account for a shift in an amount of fuel being delivered to the internal combustion when the purge control system is actuated to purge fuel from the vapor storage canister; and calculating an updated first value, the updated first value being indicative of the operation of the internal combustion engine when the internal combustion engine is not combusting fuel from the fuel vapor storage canister.

2. The method of claim 1, wherein before the step of calculating the first value, the method includes the steps of:

determining if the fuel control system is operating in a closed loop manner; and terminating the method if the fuel control system is not operating in a closed loop manner.

3. The method of claim 1, wherein before the step of calculating the first value, the method includes the steps of:

starting an purge corruption timer; and determining if a predetermined amount of time has elapsed in the purge corruption timer.

4. The method of claim 1, wherein after the step of using the first and second values to calculate the correction term, the method includes the step of repeating the above two steps until the occurrence of a predetermined condition.

5. The method of claim 4, wherein the predetermined condition is a timer value that exceeds a predetermined timer value.

6. The method of claim 4, wherein the predetermined condition is a fuel temperature in excess of a predetermined fuel temperature limit.

7. The method of claim 1, wherein the step of calculating the first value includes the steps of:

terminating a supply of fuel from the vapor storage canister to the internal combustion engine;

determining a first median oxygen filter value while the supply of fuel from the vapor storage canister to the internal combustion engine has been terminated;

determining a purge corruption value; and calculating the first value by multiplying the first median oxygen filter value by the purge corruption value.

8. The method of claim 7, wherein the step of calculating the second value includes the steps of:

purging the vapor storage canister to feed fuel to the internal combustion engine;

determining a second median oxygen filter value while the vapor storage canister is being purged to feed fuel to the internal combustion engine;

determining a second median fuel correction value; and calculating the second value by multiplying the second median oxygen filter value and the second median fuel correction value.

9. The method of claim 8, wherein the step of calculating the correction term includes the step of subtracting the second value from the first value.

10. The method of claim 1, wherein a value of the correction term ranges from zero (0) to one (1).

11. A method for calibrating the control of an engine of a motor vehicle having a fuel tank, including the steps of:

measuring an amount of purge fuel vapor flow from the fuel tank to the engine and responsively producing a purge fuel vapor flow signal;

determining an estimate of fuel corruption as a function of the purge fuel vapor flow signal and responsively producing a corruption signal; adapting the control of the engine as a function of the corruption signal;

determining if a predetermined condition has occurred; and if the predetermined condition has occurred, remeasuring the amount of purge fuel vapor flow from the fuel tank to the engine and responsively producing an updated purge fuel vapor flow signal.

12. The method of claim 11, wherein before the step of measuring the amount of purge fuel vapor flow; the method includes the steps of:

determining if the control of the engine is fueling the engine in a closed loop manner; and terminating the method if the control of the engine is not fueling the engine in a closed loop manner.

13. The method of claim 11, wherein before the step of measuring the amount of purge fuel vapor flow, the method includes the steps of:

starting an purge corruption timer; and determining if a predetermined amount of time has elapsed in the purge corruption timer.

14. The method of claim 13, further comprising the step of calculating an updated estimate of fuel corruption if the predetermined condition has not occurred, the updated estimate of fuel corruption being based on the purge fuel vapor flow signal and a current median filter value of an oxygen sensor signal.

15. The method of claim 11, wherein the step of adapting the control of the engine includes the step of using the corruption signal to calculate a correction term to account for a shift in an amount of fuel being delivered to the engine when the purge vapor flow is greater than zero.

16. A control system for controlling the fueling of an engine assembly having an internal combustion engine, a fuel control system, a fuel vapor storage canister and a purge control system for purging the fuel vapor storage canister, the control system comprising:

means for measuring an amount of purge fuel vapor flowing from the vapor storage canister to the internal combustion engine;

means for estimating an amount of fuel corruption as a function of the amount of purge fuel vapor flowing from the vapor storage canister to the internal combustion engine; and means for adapting the control of the internal combustion to the estimate of the amount of fuel corruption;

wherein on the occurrence of a predetermined condition, the purge flow measuring means calculates an updated purge flow value, the updated purge flow value being employed by the fuel corruption measuring means to calculate an updated fuel corruption estimate.

17. The control system of claim 16, wherein the means for measuring the amount of purge fuel vapor flowing from the vapor storage canister to the internal combustion engine includes an oxygen sensor.

18. The control system of claim 17, wherein the means for measuring an amount of purge fuel vapor flowing from the vapor storage canister to the internal combustion engine further includes a processor for calculating a first value and a second value, the first value being indicative of the operation of the internal combustion engine when the internal combustion engine is not combusting fuel from the fuel vapor storage canister and the second value being indicative of the operation of the internal combustion engine when the internal combustion engine is combusting fuel from the vapor storage canister.

* * * * *